United States Patent [19]

Bobadilla et al.

[11] Patent Number: 5,063,991

[45] Date of Patent: Nov. 12, 1991

[54] PROCESS FOR COOLING A CONTINUOUSLY CAST METAL PRODUCT

[75] Inventors: Manuel Bobadilla, Chatel-Saint-Germain; Jean-Marc Jolivet, Rurange-lés-Thionville; Michel Martinot, Chatel-Saint-Germain, all of France

[73] Assignee: IRSID, Maizieres-les-Metz, France

[21] Appl. No.: 563,685

[22] Filed: Aug. 3, 1990

Related U.S. Application Data

[63] Continuation-in-part of Ser. No. 350,488, May 11, 1989, abandoned.

[30] Foreign Application Priority Data

May 13, 1988 [FR] France ..... 88 06743

[51] Int. Cl.[5] ..... B22D 11/124

[52] U.S. Cl. ..... 164/468; 164/486; 164/444

[58] Field of Search ..... 164/486, 444, 468

[56] References Cited

U.S. PATENT DOCUMENTS

| | | | |
|---|---|---|---|
| 3,502,133 | 3/1970 | Carson | 164/444 |
| 3,512,574 | 5/1970 | Taylor | 164/487 |
| 3,771,584 | 11/1973 | Wojcik | 164/455 |
| 3,931,848 | 1/1976 | Schmid | 164/444 |
| 4,541,472 | 9/1985 | Eriksson | 164/444 |
| 4,617,067 | 10/1986 | Gueussier | 164/486 |
| 4,624,298 | 11/1986 | Rudolph | 164/486 |

FOREIGN PATENT DOCUMENTS

| | | | |
|---|---|---|---|
| 57-142752 | 9/1982 | Japan | 164/486 |
| 59-87962 | 5/1984 | Japan | 164/486 |
| 61-119360 | 6/1986 | Japan | 164/486 |
| 62-263855 | 11/1987 | Japan | 164/486 |

*Primary Examiner*—Richard K. Seidel
*Assistant Examiner*—Rex E. Pelto
*Attorney, Agent, or Firm*—Pollock, Vande Sande & Priddy

[57] ABSTRACT

Energetic cooling of the product is performed during continuous casting when, at the core, the product is in a phase of pasty solidification so that the differential thermal contraction between the mushy core and the already completely solidified outer shell produces a squeezing effect of the core by the shell. To this end, means for cooling the product are arranged on the casting machine at the end section of the metallurgical length. The process makes it possible to reduce, and even to avoid, the formation of inner cracks during cooling of the cast product which would lead to the presence of segregated areas in the axial zone. It is applied advantageously to the casting of steels reputed to be difficult to cast continuously, such as steels with a long solidification range whose carbon content is from 0.25 to 1.5%.

10 Claims, 2 Drawing Sheets

PROCESS FOR COOLING A CONTINUOUSLY CAST METAL PRODUCT

This application is a CIP of 07/350,488 filed 5/11/89 now abandoned.

FIELD OF THE INVENTION

The present invention relates to a process for cooling a metal product during continuous casting intended to reduce, and even to eliminate, the presence of a large segregated zone in the central part of the product. This process may be advantageously applied to the continuous casting of products in steel reputed to be difficult to cast using this technique, such as steels having a long solidification period, i.e., for example, those whose carbon content is and about 0.25 and 1.5%.

PRIOR ART

In order to clarify the following text, it will be advantageous to represent the product in the course of solidification as the combination of three concentric bodies, namely: a ring consisting of the already solidified outer shell or skin, surrounding another ring in the pasty state which surrounds the liquid core of molten metal. Pasty state is understood to refer to a state in which the metal is at a temperature where liquid metal and solid crystals coexist in variable proportions. During the extraction of the product, the latter advances slowly along the machine while being cooled such that the solidification progresses from the periphery towards the center. The liquid core and the pasty ring therefore have conical profiles whose points are oriented towards the bottom of the machine. The interfaces between these different concentric bodies constitute, respectively, as it is customary to denote them, the finishing and commencing solidification contours. At an advanced stage of solidification, the liquid core disappears (bottom of the commencing solidification well), and only a solidified crust and a pasty core remain. As the proportion of solid material within the liquid phase of said pasty core increases, the solid material forms a skeleton connected to the completely solidified ring. At a later stage, the pasty zone in its turn disappears (closure of the finishing solidification well) and the product is completely solidified.

Solidification and cooling of the product during casting are normally provided in three successive zones of the continuous casting machine, namely, in the direction of progression of the product during its extraction:

- the ingot mould, where the liquid metal enters into contact with walls which are good conductors of heat and energetically cooled by circulation of water. It is in this so-called primary cooling zone that the formation of the solidified skin surrounding the liquid core of the product starts and that the product assumes its final form;
- the so-called "secondary cooling" zone, which starts just below the ingot mould and extends over a length which is variable according to local conditions. In this zone, the solidified skin of the advancing product is sprayed with a cooling fluid (generally sprayed water or an air/water mixture), the effect of which is to accelerate the progression of the commencing and finishing solidification contours towards the inside of the product. However, at the location where the spraying of the water ceases, complete solidification of the product is not achieved and the core of the product remains in the liquid state;
- and the portion of the machine which follows the secondary cooling zone. The advancing product is no longer sprayed here and it cools naturally. It is in this zone that solidification of the core of the product is achieved.

Forced cooling of the product in the ingot mold and after its emergence from the ingot mold gives rise to a rapid increase in the thickness of the solidified skin, in order to limit the risks of holing and to substantially increase the extraction speed of the product, upon which the productivity of the continuous casting machine directly depends.

Moreover, the solubility in iron of the alloying elements, such as carbon, is lower when the iron is in the solid state than in the liquid state. In the pasty ring, there are therefore local differences in concentration, for example of carbon, in the liquid.

If there is movement of carbon-enriched liquid within the pasty ring, this is reflected in the presence, at the center of the completely solidified product, of so-called "segregated" zones where the concentration of carbon (and/or other segregating elements) is substantially higher than in the other regions. The other alloying elements have a behavior similar to that of carbon and the location of the segregated zones may be deduced from tests, commonly referred to as "Baumann printing", which make it possible to locate the distribution of sulfur over a polished section of the product. These segregated zones, which may also be located by metallographic etching, have an adverse influence on the homogeneity of the mechanical properties of the product. Thus, the relatively high carbon concentration at the center gives rise to greater hardness in these zones than in the rest of the product after rolling.

This phenomenon is particularly marked in the case of steels with a very high charge of alloying elements, such as those containing 0.5 to 1.5% of carbon, and which are currently referred to as steels with a long solidification range, e.g., the 100 C6 grade of bearing steel.

A "Baumann printing" performed on a sample of the product taken along the longitudinal axis of the latter would show that the segregations are distributed about the axis of the product in "Vees", and the mechanisms of formation are, furthermore, still not totally clear.

Attempts have been made to solve this problem by applying electromagnetic agitation of the metal in the zone of pasty solidification in order to force the segregated liquid to be distributed over a larger zone. However, in so doing, the effects are in fact corrected without the causes of the phenomenon really being addressed. Moreover, this technique involves the acquisition of at least one agitation inductor as well as considerable operating costs.

SUMMARY OF THE INVENTION

An object of the present invention is to propose a simple and economic solution for reducing and even eliminating the highly segregated zones in the core of continuously cast products by addressing the actual cause responsible for their formation. It may be added to or replace electromagnetic agitation in the zone of the end of pasty solidification.

To this end, the subject of the invention is a process for cooling a metal product, in particular made of steel, during continuous casting, characterized in that forced cooling of the product is performed while the product is in a phase of pasty solidification, this cooling being conducted so that the differential thermal contraction between the pasty core and the already completely solidified shell surrounding it permanently gives rise to a squeezing effect of the core by the shell. This cooling is implemented in a zone extending at least between a first point where, in the absence of such cooling, the speed of decrease of the temperature of the pasty core of the product would exceed that of the surface of the product and a point at which the proportion of solid material within the liquid phase of said pasty core is at least 60% by weight.

As will have been understood, the invention in fact consists in using the solidified outer shell as a vise accompanying the contraction of the core during cooling. In other words, the internal diameter of the ring formed by the solidified shell must decrease more quickly than would the diameter of the pasty core if the shell were exerting no action at all on the core. This vise is implemented thermally simply by means of an accelerated cooling of the surface of the product in the lower part of the machine where the product is customarily left to cool naturally.

It has been indicated above that the causes of the formation of segregated "Vees" in the central part of the cast product had to date not been completely identified and explained.

However, the hypothesis put forward by the inventors as being the most probable and which underlies the present invention may be outlined as follows.

When passing through the secondary cooling zone, the skin of the product cools rapidly, whereas the liquid core remains at a virtually constant temperature. As the product passes into the natural cooling zone, the cooling of the skin, which is no longer sprayed, becomes much slower. On the other hand, bearing in mind the usual length of the secondary cooling zone, it is only when most of the product has already entered the natural cooling zone that the temperature of the core (which is then in the pasty state) tends to drop substantially.

The inner pasty part of the product then cools more rapidly than the solid layer surrounding it and undergoes a greater thermal contraction. The mechanical stresses thereby created are released by the formation of cracks in the central block which was previously "pasty", cracks into which highly segregated liquid may penetrate by means of suction.

Therefore, in the completely solidified product, the locations of these cracks will be located by means of their high concentration of alloying elements leading to the above-mentioned defects.

In the case of steels with a high charge of alloying elements, such as carbon, such as the 100 C6 for example, the difference between the starting and finishing temperatures of solidification is relatively large, and it is therefore likely that the pasty solidification will take place over a more extended zone than in the case of low-alloy grades. Combined with a greater sensitivity to the segregation of the elements between the liquid and solid phases, this explains why the alloyed grades are subject at this point to the formation of segregated zones in the axial region of continuously cast products. In certain extreme cases, such defects make it impossible to obtain a finished product of sufficient quality and require the abandonment of their production using continuous casting.

It has just been seen how the invention, by causing thermal contraction of the solid outer shell, counteracts the tendencies of the product to form these internal cracks which are responsible for highly segregated central zones.

BRIEF DESCRIPTION OF THE DRAWINGS

The invention will be clearly understood and other characteristics and advantages will emerge from the following detailed description given with reference to the appended plates of drawings, in which.

DESCRIPTION OF A PREFERRED EMBODIMENT

Figures 1, 2:
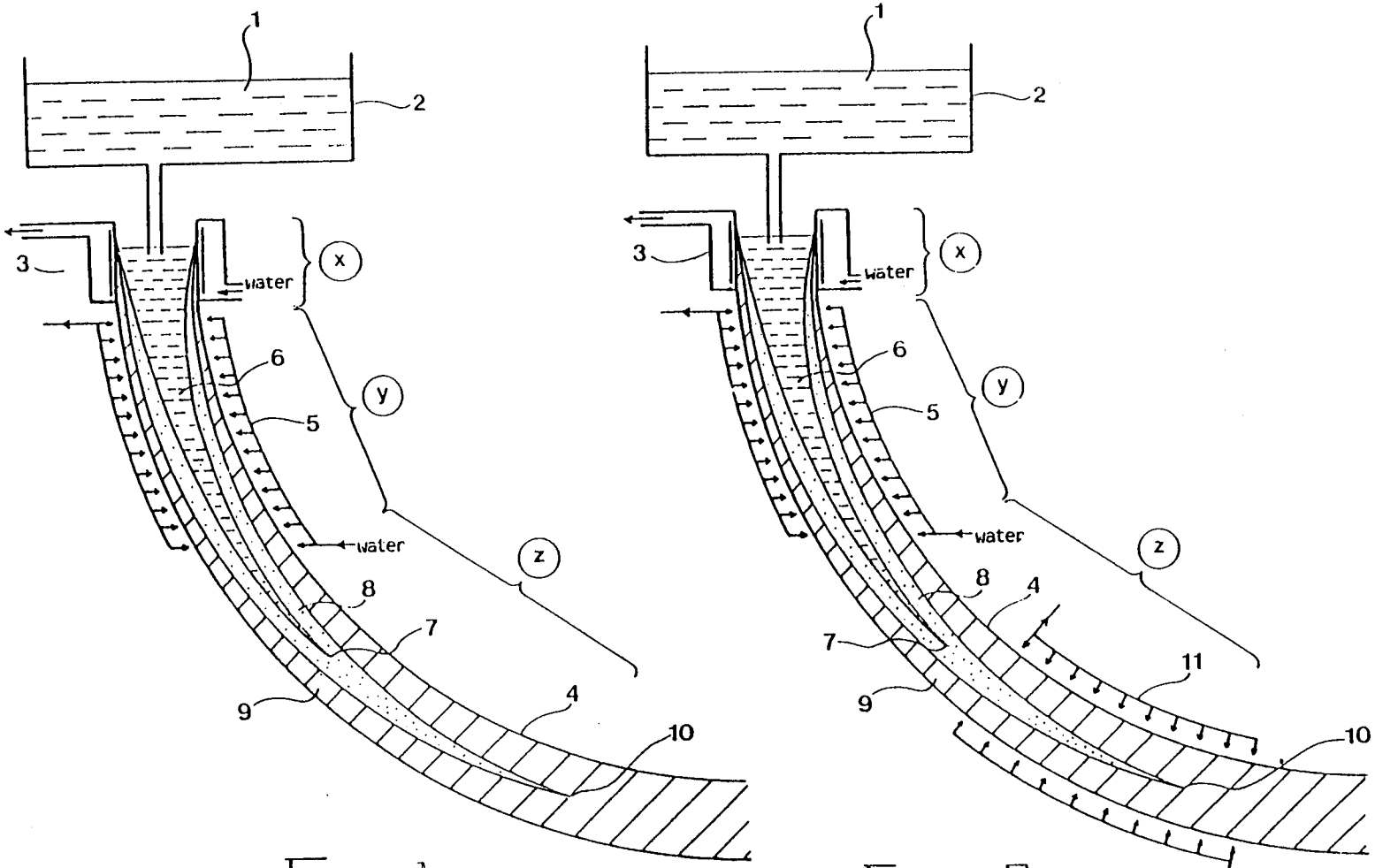
FIG. 1 is a schematic representation of a conventionally designed curved continuous casting installation for semi-finished steel products.
FIG. 2 represents the installation of FIG. 1 modified according to the invention by the addition of a cooling ramp in the zone of the end of solidification of the product.

FIG. 1 is a longitudinal schematic section of a conventional continuous casting installation and it shows, in particular, the product in the course of solidification. A ladle (not shown) feeds liquid steel 1 into a tundish 2. The liquid steel 1 then flows into one or more ingot molds 3 with copper or copper alloy walls which are energetically cooled by water. It is in each of these ingot molds or primary cooling zones X that the solidification of a product 4 begins at its periphery, which product will in this manner assume its final section. The ingot mold shown in FIG. 1 has a curve which is reproduced on the product. The case of the straight ingot mold giving rise to a straight product is also found in industrial practice. The secondary cooling zone Y, in which the product 4 is sprayed by a ramp of injectors 5 over a length which varies according to the machines starts just below the ingot mold 3. The injectors spray the entire perimeter of the product with a cooling fluid, generally sprayed or atomized water. The natural cooling zone Z comes next, where a conventional machine, such as that shown, does not comprise means for cooling the product. In the lower part of the machine are means (not shown) for straightening the product which are responsible for giving it a straight form, and means (not shown) for cutting the product to length.

FIG. 1 makes it possible to distinguish several concentric regions inside the product being cast, corresponding to the physical state of the material they contain. In a section of the product located in the upper part of the machine (for example, in the zone Y), three successive regions are found. In the core (region 6), the metal is entirely in the liquid state; the section of this zone diminishes as the product solidifies and after the point of closure 7 of the liquid well 7, no further liquid metal is found alone. Around the liquid core 6, a pasty region 8 corresponding to the metal in the course of solidification contains both liquid and solid metal. The proportion of the latter increase as the temperature decreases. Finally around the pasty region, the shell 9 consists only of solidified metal. Beyond the point of closure of the well 10 of finishing solidification this region 9 extends over the entire product, the solidification of which is then completed.

FIG. 2 shows the continuous casting machine of FIG. 1 modified according to the invention. The elements which are common with FIG. 1 have the same reference numerals. The difference between the two configurations lies in the addition to the original machine of a second injector ramp 11 located in the zone Z of the machine where the product completes its solidification.

Figure 3:
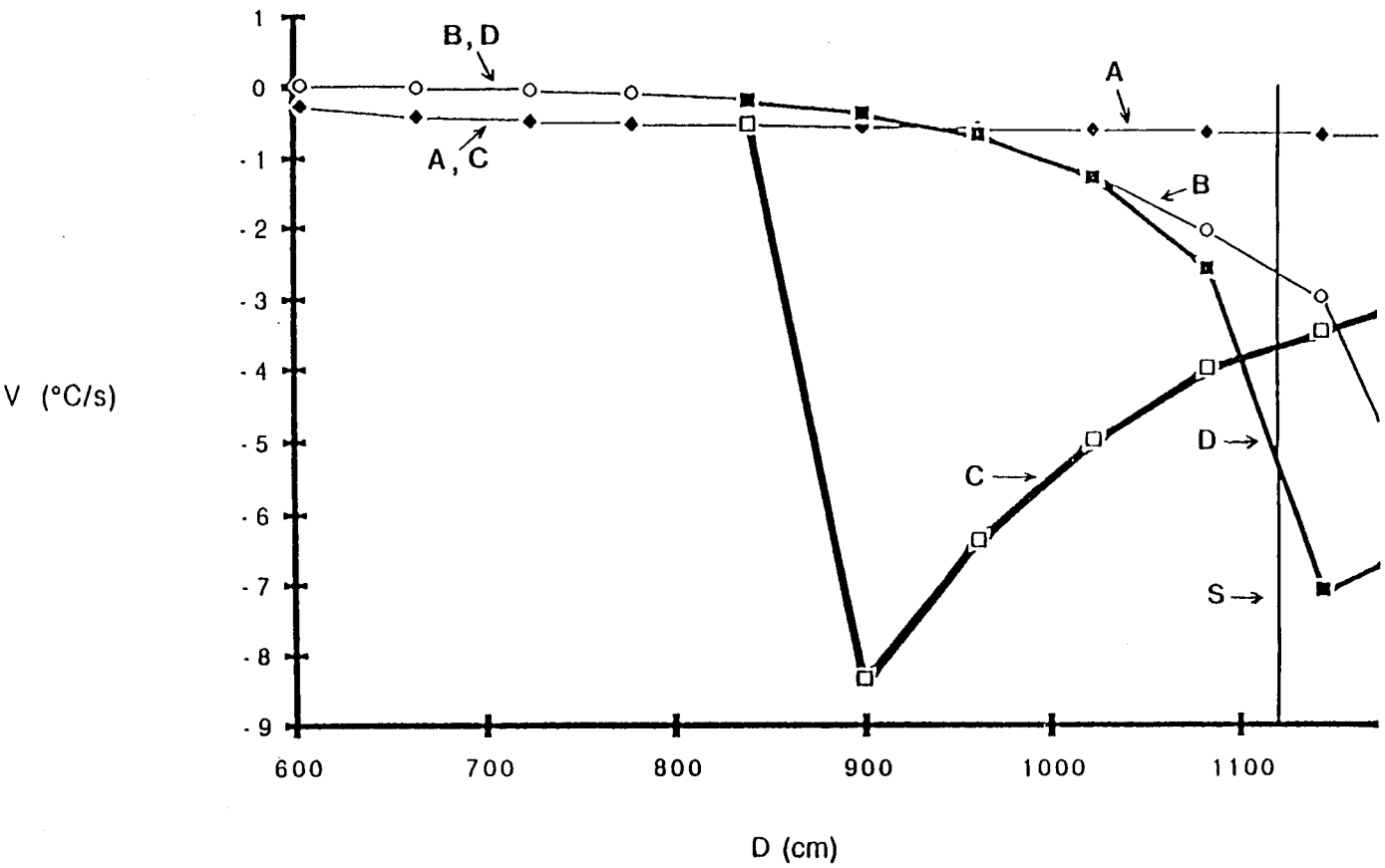
FIG. 3 shows the evolution of the speeds of cooling of the surface and of the core of the product during its advance into the lower part of the machine. Cases of both the absence and the presence of a cooling device in the zone of the end of solidification of the product are shown.

FIG. 3 shows examples of evolution of the speed V of decrease of the temperature of the metal at the surface and at the core as the product advances in the zone Z of the machine where it completes its solidification. This advance is expressed by the distance D to the meniscus, i.e., the surface of the liquid metal in the ingot mold. The curves have been drawn with the aid of mathematical models similar to those available to the users of continuous casting machines. They apply in the following casting conditions:

format of the product square-section billets, with a side of 105 mm, composition of the product : steel with 0.7% carbon, speed of extraction of the product : 3.3 m/min.

Under these conditions, the complete solidification of the product is achieved at a distance of 11.20 m from the meniscus, marked on the figure by the line S.

The curves A and B correspond to the case of FIG. 1 where the product, in the end part of the machine, is not subjected to any forced cooling. The curve A represents the speed of decrease of the temperature at the surface of the product. It shows that this speed remains substantially constant (i.e., a loss of 0.5° C./s) over the entire length of the zone in question. The curve B represents the speed of decrease of the temperature of the pasty core of the product. It shows that, at the start of the zone in question, this temperature remains virtually constant, as the decrease of the temperature, expressed by the speed V, appears to be close to 0° C./s. It is only from a distance to the meniscus of approximately 8 m that the cooling of the pasty core accelerates considerably. At a distance to the meniscus of 9.5 m, curve B crosses curve A. This means that, beyond this point, the pasty core begins to lose more than 0.5° C./s and therefore that the speed of decrease of the temperature of the pasty core begins to exceed the speed of decrease of the temperature of the surface of the product. This involves a thermal contraction of the core which is greater than that of the surface; it is this phenomenon which, according to the hypothesis put forward by the inventors, was the cause of defects in the product which the invention aims to prevent.

The curves C and D correspond to the case of FIG. 2 where the product, according to the invention, is subjected to forced cooling in the zone Z of the end of solidification by means of the ramp of injectors 11. These curves have been drawn on the assumption that the product is sprayed, between the distances to the meniscus of 8.40 m and 11.20 m, with water at a flow rate of 12 $m^3$ per hour and per $m^2$ of sprayed product, this flow rate being distributed homogeneously over the entire spraying zone. The distance to the meniscus 8.60 m was chosen according to the curves A and B of FIG. 3, i.e., a distance which is less than the distance 9.50 m at which, in the absence of such spraying zone (see FIG. 1) the speed of decrease of the temperature of the pasty core begins to exceed the speed of decrease of the temperature of the surface of the product. The curve C represents, when the product is sprayed according to the invention, the speed of decrease of the temperature of the surface of the product, and the curve D represents, under the same conditions, the speed of decrease of the temperature of the pasty core. Upstream of the cooling zone, these curves coincide with the curves A and B, respectively. From the start of the forced cooling zone, the cooling of the surface accelerates suddenly to 9° C./s at the distance to the meniscus of 9 m. The cooling then slows increasingly due to the progressive deterioration in the heat exchanges between the cooling water (whose flow rate and temperature are constant) and the product (whose temperature decreases as it progresses into the cooling zone). Simultaneously, the forced cooling results in an acceleration of the cooling of the pasty core, but this effect is felt only belatedly (from the distance to the meniscus of 10 m) and progressively. All in all, it is only at a distance to the meniscus of 11 m that curve D crosses curve C. This means that at this distance the cooling of the pasty core becomes more rapid than that of the surface of the product. At this level, the pasty core has virtually completed its solidification and the solidified skeleton contained in it and connected to the solidified shell has sufficient rigidity to avoid the formation of cracks, since it cannot be frankly distinguished by its mechanical properties from the solidified shell. Thus, the phenomenon of differential thermal contraction is negligible and for it is impossible for the segregated "Vees" to be formed. It is therefore useless to further spray the surface of the product, and this accounts for the choice of the distance to the meniscus 11.20 m where the spraying is stopped.

The example described above is not, of course, limiting. A figure similar to FIG. 3 may be drawn for any continuous casting machine on which a given product would be cast under specific conditions.

The feeling is that, beyond the point where the solid fraction of the pasty core of the product reaches 90%, it is always futile to continue spraying. In certain cases, it is even sufficient to spray only up to a solid fraction of 60%.

It is advisable to continue the forced cooling of the product up to approximately 1 m beyond the point of the end of the solidification determined by the calculation, bearing in the mind the uncertainty surrounding this calculation. It is with this in mind that, in FIG. 2, the cooling ramp 11 is represented as extending beyond the point 10. Similarly, the uncertainty of the calculation surrounding the determination of the point of intersection between the curves A and B of FIG. 3 is ±1 m approximately. The choice of the point where the forced cooling starts must take this uncertainty into account. It is therefore advisable to place the first injectors of the ramp 11 at least 1 m upstream of the said point of intersection, which was assumed int he numbered example shown in FIG. 3 as explained hereinabove. However, it is also necessary to ensure that this advance of the start of cooling does not cause premature crossing of the curves C and D of FIG. 3, i.e., at a point where the solid fraction of the pasty core would be less than at least 60%.

The recommended flow rates of cooling water are of the order of 8 to 15 $m^3/h$ and per $m^2$ of sprayed, metal. A flow rate of 12 $m^3/m^2$ .h is preferred.

This process may be readily adapted to all continuous casting machines intended for the manufacture of steel products. It is more especially designed for the casting of grades of steel containing approximately 0.25 to 1.5% of carbon.

An alternative version of this process would consist in designing the cooling ramp 11 so that the flow of cooling fluid varies between the start and the end of the cooling zone. The value of the mean overall flow rate on the entire zone would be unchanged with respect to the configuration described above. In this manner, it would be possible to better control the flow of heat extracted from the product along the cooling zone, with the aim of slowing the reduction of the speed of decrease of the surface temperature of the product shown in curve C in FIG. 3. In this manner, the probability of achieving cooling at the core which is less rapid than at the skin up to the absolute end of solidification would be increased.

On the other hand, it has been noted that a good homogeneity of the core of the product to which the process was to be applied was favorable to the reproducibility of the satisfactory metallurgical results sought. It was possible to observe that this homogeneity could advantageously be obtained by causing movement of the liquid core in the secondary cooling zone or even in the ingot mold. This movement may be favorably obtained with the aid of electromagnetic agitation means which are now widely known in the field of continuous casting. These means may consist of multiphase annular inductors arranged around the cast product and producing a magnetic field rotating about the casting axis, or of multiphase inductors of plane structure producing a sliding field, parallel to the casting axis or parallel to the latter. The literature is now full of information on this type of agitation. For further details, reference could be made, if desired, to the following documents: French Patent 2,315,344, on agitation via rotating field in an ingot mold, French Patent 2,211,305, relating to agitation by means of rotating field in the secondary cooling zone; and Luxembourg Patent 67,753, relating to agitation with the aid of inductors producing a sliding field perpendicular to the casting axis in the secondary cooling zone. The teachings of these documents are incorporated by reference in the present description.

The process according to the invention may be applied to vertical, straight or curved continuous casting machines and also to horizontal continuous casting machines and additionally to existing or future installations for the direct continuous casting of products of small thickness.

In addition, the invention applies not only semi-finished iron and steel products, but extends to any metallurgical product which is, or is capable of being, continuously cast.

The invention also applies to any continuously cast metallurgical product regardless of its format, blooms, billets or slabs, in particular those intended for splitting in order to form blooms.

We claim:

1. In a process for cooling a metal product during continuous casting of said product, said process comprising the steps of (a) in a bottomless mold defining the size of said product, primary cooling of metal in a liquid state, producing a solidified outer shell surrounding a liquid core of said product;

(b) secondary cooling by applying a cooling medium to a free surface of said outer shell out of said mold, to perform progressive metallic solidification toward an interior of said product, said solidification causing development of a phase of pasty solidification between said solidified outer shell and said liquid core;

(c) stopping said secondary cooling before complete solidification of said product and while a said liquid core of said product still remains; and the improvement comprising (d) forced cooling of said product to supplement said natural cooling, said forced cooling being conducted in a zone extending along a casting machine between a first point where said core of said product is in said pasty solidification phase and where, in the absence of said forced cooling, the speed of decrease of the temperature of said pasty solidification phase would begin to exceed the speed of decrease of temperature of a surface of said product, and a second point at which the proportion of solid material within the liquid phase of said pasty core is at least 60% by weight;

(e) whereby differential thermal contraction between said core in said pasty solidification phase of said product and said solidified outer shell results in a permanent squeezing effect by said outer shell on said core in said pasty solidification phase.

2. Process according to claim 1, wherein said forced cooling comprises spraying a cooling fluid onto a surface of a cast product.

3. Process according to claim 2, wherein said cooling fluid is water at a mean flow rate of between 8 and 15 $m^3$ per hour and per $m^2$ of sprayed product.

4. Process according to claim 3, wherein said mean flow rate is about 12 $m^3$ per hour and per $m^2$ of sprayed product.

5. Process according to claim 2, wherein the flow rate of cooling fluid varies between start and finish of a cooling zone.

6. Process according to any one of claims 1 and 2, wherein said process is applied to the casting of products made of steel whose content of carbon by weight is of the order of 0.25 to 1.5%.

7. Process according to any one of claim 1, including simultaneously moving a liquid core of the product with the aid of agitation means.

8. Process according to claim 7, wherein said agitation means comprise at least one inductor with a movable electromagnetic field.

9. Process according to claim 8, wherein said at least one inductor surrounds the cast product and generates a magnetic field rotating about a casting axis.

10. Process according to claim 8, wherein said at least one inductor is of plane structure producing a sliding field within the cast product.

* * * * *